US010813395B1

(12) United States Patent
Bankole et al.

(10) Patent No.: US 10,813,395 B1
(45) Date of Patent: Oct. 27, 2020

(54) REVERSIBLE GARMENT

(71) Applicants: Bukola Bankole, Huntingtown, MD (US); Aderemi Lawrence Bankole, Huntingtown, MD (US)

(72) Inventors: Bukola Bankole, Huntingtown, MD (US); Aderemi Lawrence Bankole, Huntingtown, MD (US)

( * ) Notice: Subject to any disclaimer, the term of this patent is extended or adjusted under 35 U.S.C. 154(b) by 0 days.

(21) Appl. No.: 16/879,542

(22) Filed: May 20, 2020

(51) Int. Cl.
*A41D 15/00* (2006.01)
*A41D 27/24* (2006.01)

(52) U.S. Cl.
CPC ..... *A41D 15/005* (2013.01); *A41D 27/24* (2013.01); *A41D 2300/50* (2013.01)

(58) Field of Classification Search
CPC ... A41D 15/005; A41D 27/24; A41D 2300/50
USPC ..... 2/69
See application file for complete search history.

(56) References Cited

U.S. PATENT DOCUMENTS 2,136,974 A * 11/1938 Kanovitz ..... A41D 15/005 2/85
2,515,089 A * 7/1950 Kamhi ..... A41D 15/005 2/211
2,759,192 A * 8/1956 Levi ..... A41D 1/06 2/227
3,234,564 A * 2/1966 Chujfi ..... A41D 1/06 2/227
3,425,062 A * 2/1969 Chujfi ..... A41D 27/20 2/227
4,686,714 A * 8/1987 Harley ..... A41D 15/005 2/105
5,561,860 A * 10/1996 Nguyen-Senderowicz ..... A41D 15/005 2/115
7,441,281 B2 * 10/2008 Salem ..... A41D 15/005 2/115
2007/0028364 A1 * 2/2007 Oomae ..... A41F 9/025 2/237
2011/0185470 A1 * 8/2011 Jones ..... A41D 1/06 2/69
2013/0305425 A1 * 11/2013 Zarabi ..... A41D 1/06 2/69
2014/0026287 A1 * 1/2014 Clinton-Starks ..... A41D 15/005 2/69
2014/0182043 A1 * 7/2014 Moore ..... A41D 1/04 2/69

* cited by examiner

*Primary Examiner* — Katherine M Moran

(57) ABSTRACT

A reversible garment includes a plurality of pieces of a fabric joined by one or more seams, each seam constructed by joining a first edge of a first piece of the fabric and a second edge of a second piece of the fabric. The fabric includes a first presenting surface having a first appearance and a second presenting surface having a second appearance, the second presenting surface being opposite the first presenting surface, and the second appearance being different from the first appearance. A main portion of the reversible garment is formed by a single layer of the fabric without a lining, and the reversible garment is configured to be worn in a first mode displaying the first presenting surface of the fabric outwardly and a second mode displaying the second presenting surface of the fabric outwardly. For each seam, the first edge and the second edge are enclosed in the seam and hidden from view both when the reversible garment is worn in the first mode and when the reversible garment is worn in the second mode.

14 Claims, 7 Drawing Sheets

REVERSIBLE GARMENT

CROSS-REFERENCE TO RELATED APPLICATION

This is a first filed application.

TECHNICAL FIELD

The present disclosure relates to the technical field of garment design and construction, in particular to a reversible garment.

BACKGROUND

There are a wide variety of designs for each type of garments, including various colors, patterns, sizes, and shapes. Many wearers prefer to frequently vary the design of their outfits as a fashion expression, resulting in purchasing and owning many garments that serve similar utility functions. Therefore, it is desirable to create garments that are flexible to vary and customize without consuming additional resources and occupying additional storage space.

SUMMARY

The present disclosure provides a reversible garment. The reversible garment includes a plurality of pieces of a fabric joined at one or more seams, each seam constructed by joining a first edge of a first piece of the fabric and a second edge of a second piece of the fabric; wherein: the fabric includes a first presenting surface having a first appearance and a second presenting surface having a second appearance, the second presenting surface being opposite the first presenting surface, and the second appearance being different from the first appearance; a main portion of the reversible garment is formed by a single layer of the fabric without a lining, and the reversible garment is configured to be worn in a first mode displaying the first presenting surface of the fabric outwardly and a second mode displaying the second presenting surface of the fabric outwardly; and for each seam, the first edge and the second edge are enclosed in the seam and hidden from view both when the reversible garment is worn in the first mode and when the reversible garment is worn in the second mode.

In certain embodiments, each seam is constructed by a process of: stitching together the first piece and the second piece close near the first edge and the second edge with a first stitch line, wherein the first presenting surface of the first piece of the fabric is arranged to face the second presenting surface of the second piece of the fabric; trimming a first seam allowance at the first edge to cause the first seam allowance to be narrower than a second seam allowance at the second edge; folding the second seam allowance toward the first presenting surface of the second piece of the fabric along the seam; and stitching the folded second seam allowance to the second presenting surface of the first piece of the fabric with a second stitch line, the second stitch line being parallel to the first stitch line.

In certain embodiments, the reversible garment further includes one or more hems; and for each hem, the hem is constructed near an edge of one of the plurality of pieces of the fabric, and the hem is constructed so that the edge is hidden from view both when the reversible garment is worn in the first mode and when the reversible garment is worn in the second mode.

In certain embodiments, for each hem, the hem is constructed so that a hem portion presents a fabric appearance consistent with other portion of the reversible garment both when the reversible garment is worn in the first mode and when the reversible garment is worn in the second mode.

In certain embodiments, for each hem, the hem is constructed with a main piece of the fabric and a hem piece of the fabric, the hem piece configured to cover the hem portion, and the hem is constructed by a process of: folding a top edge of the hem piece toward the second presenting surface of the hem piece; folding a bottom edge of the hem piece toward the second presenting surface of the hem piece; folding a bottom edge of the main piece toward the first presenting surface of the main piece; and sewing the hem piece to the main piece at the hem portion with the second presenting surface of the hem piece facing the first presenting surface of the main piece.

In certain embodiments, the first presenting surface and the second presenting surface of the fabric have different colors, different printed pattern, and/or different fabric textures.

In certain embodiments, the reversible garment further includes one or more faux welt pockets.

In certain embodiments, the one or more faux welt pockets are visible both when the reversible garment is worn in the first mode and when the reversible garments is worn in the second mode.

In certain embodiments, the reversible garment further includes a single-pull two-way zipper configured to be zipped and unzipped both when the reversible garment is worn in the first mode and when the reversible garment is worn in the second mode.

In certain embodiments, the reversible garment further includes one or more of buttons, bell loops, ruffles, and/or embroideries.

In certain embodiments, when worn in the second mode, an upper portion of the reversible garment is folded outwardly to present the second presenting surface of the fabric in the upper portion.

In certain embodiments, the fabric is an elastic fabric. In certain other embodiments, the fabric is a non-elastic fabric.

In certain embodiments, the reversible garment is a dress. In certain embodiments, the reversible garment is a blouse or a shirt. In certain embodiments, the reversible garment is a skirt. In certain embodiments, the reversible garment is a pair of trousers.

In certain embodiments, the fabric is made of wool, cotton, silk, linen, a synthetic material, a semi-synthetic material, or a blend of plurality of materials.

In certain embodiments, for each of the first stitch line and the second stitch line constructing the seam: the stitch line is constructed using a top thread having a first color and a bottom thread having a second color, the first color being coordinated with the first appearance of the first presenting surface of the fabric, the second color being coordinated with the second appearance of the second presenting surface of the fabric, and the second color being different from the first color.

In certain embodiments, for each of third stitch line and the fourth stitch line constructing the hem: the stitch line is constructed using a top thread having a first color and a bottom thread having a second color, the first color being coordinated with the first appearance of the first presenting surface of the fabric, the second color being coordinated with the second appearance of the second presenting surface of the fabric, and the second color being different from the first color.

BRIEF DESCRIPTION OF THE DRAWINGS

In order to more clearly illustrate the technical solutions in the embodiments of the present disclosure, the drawings used in the description of the embodiments will be briefly described below. It is obvious that the drawings in the following description are only some embodiments of the present disclosure. Other drawings may be obtained by those of ordinary skill in the art based on these drawings.

DETAILED DESCRIPTION

Figure 1:
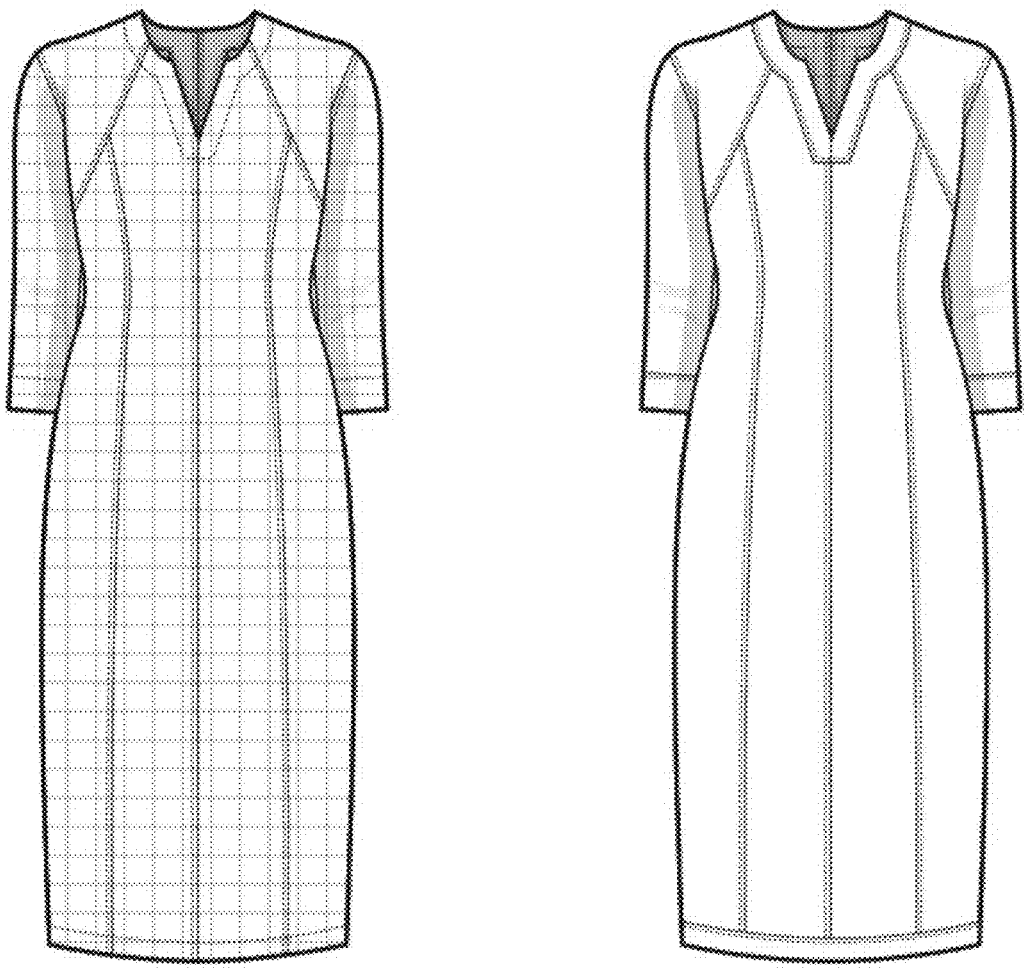
FIG. 1 illustrates a reversible garment according to certain embodiments of the present disclosure.

The technical solutions according to the embodiments of the present disclosure described in the following with reference to the accompanying drawings. The described embodiments are only part of the embodiments of the present disclosure, but not all the embodiments. All other embodiments obtained by a person of ordinary skill in the art based on the embodiments of the present disclosure without creative efforts are within the scope of the present disclosure. The features of the embodiments described below may be combined with each other when there is no conflict.

It should be noted that, in the following description, relational terms such as "first" and "second" are used merely to distinguish one entity or operation from another entity or operation, and do not necessarily require or imply actual relationship or order between these entities or operations. The terms "comprise", "include", or any other variations intended to cover a non-exclusive inclusion, such that a process, method, article, or device that having a plurality of elements, include not only those elements but also other items not specifically listed elements, or elements that are inherent to such a process, method, item, or device. Unless otherwise limited, an element that is defined by the phrase "comprising a . . . " does not exclude the presence of additional equivalent elements in the process, method, item, or device that comprises the element.

The present disclosure provides a reversible garment and a construction method thereof. The reversible garment may provide different looks when worn in a first mode and a second mode. The second mode may be a mode in which at least a portion of the fabric of the garment is configured to show a different presenting surface of the fabric compared to the first mode. The reversible garment may be a dress, a skirt, a pair of trousers, a shirt, a blouse, and so on. The present disclosure does not limit the garment utility category, shape, or design.

In certain embodiments, a main portion of the reversible garment may be constructed with a single layer of fabric without a lining. The fabric may be made of cotton, wool, silk, linen, synthetic or semi-synthetic materials, or a blend of a plurality of materials. The present disclosure does not limit material composition of the fabric. In certain embodiments, the fabric may comprise a first presenting surface having a first appearance, and a second presenting surface opposite the first presenting surface and having a second appearance. The first appearance of the first presenting surface may be different from the second appearance of the second presenting surface. For example, the first and second presenting surfaces may have different colors, different print patterns, and/or different textures. When the garment is being worn or configured in the first mode, the first presenting surface of the fabric may be presented outwardly, and the garment may appear to be made of a fabric having the first appearance. When the garment is being worn or configured in the second mode, the second presenting surface of the fabric may be presented outwardly at least for a portion of the garment, and the garment may appear to be made of a fabric having a second appearance.

FIG. 1 shows an exemplary embodiment of the reversible garment. As shown in FIG. 1, in certain embodiments, the reversible garment may be a dress made from a single layer of fabric. The left panel of FIG. 1 shows the dress being worn in the first mode showing the first presenting surface of the fabric, and the right panel of FIG. 1 shows the same dress being worn in the second mode showing the second presenting surface of the fabric. As shown in the left panel of FIG. 1, the first presenting surface of the fabric may have a first color and a first printed pattern, such as a dark gray plaid print. As shown in the right panel of FIG. 1, the second presenting surface of the fabric may have a different appearance from the first presenting surface, e.g., may have a solid black color. As a result, the dress as being worn in the two different modes presents two different appearances, providing the wearer variety in dressing style without incurring additional expense, resource requirement, and storage space.

Figure 2:
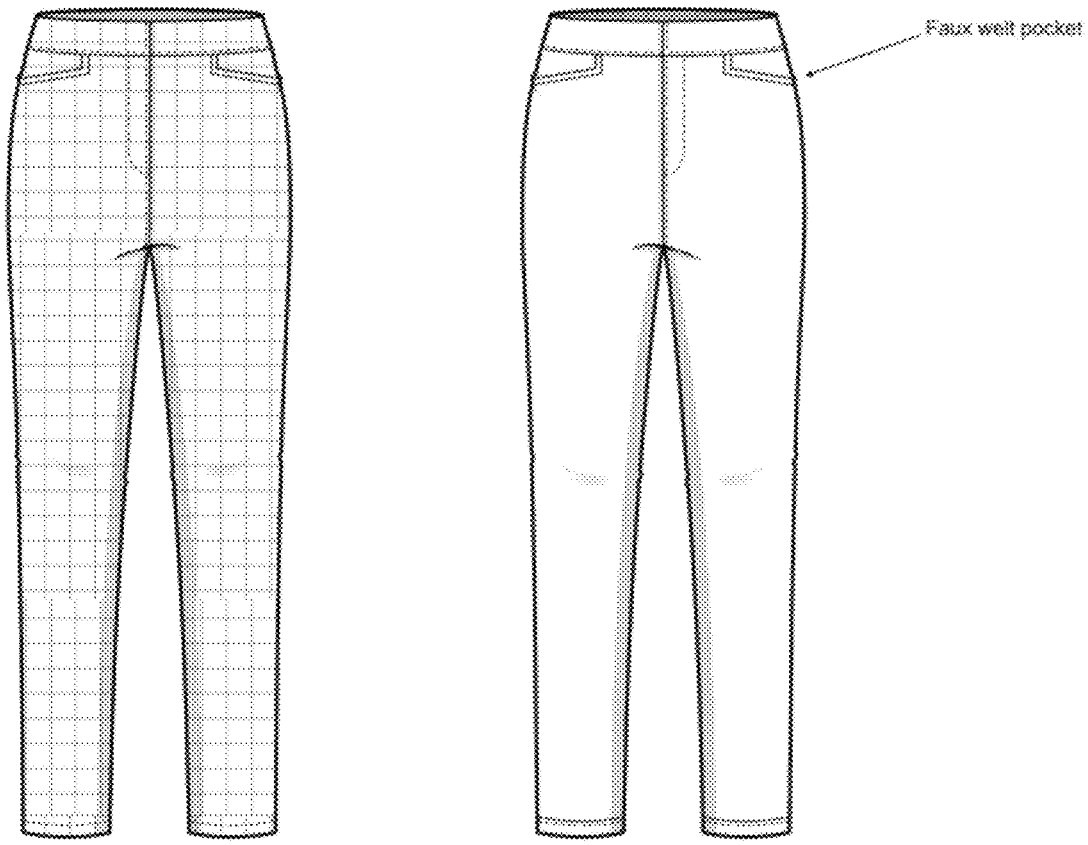
FIG. 2 illustrates another reversible garment according to certain embodiments of the present disclosure.

FIG. 2 shows another exemplary embodiment of the reversible garment. As shown in FIG. 2, in certain embodiments, the reversible garment may be a pair of trousers made from a single layer of fabric. The left panel of FIG. 2 shows the trousers being worn in the first mode showing the first presenting surface of the fabric, and the right panel of FIG. 2 shows the same pair of trousers being worn in the second mode showing the second presenting surface of the fabric. As shown in the left panel of FIG. 2, the first presenting surface of the fabric may have a first color and a first printed pattern, such as a dark gray checkered print. As shown in the right panel of FIG. 2, the second presenting surface of the fabric may have a different appearance from the first presenting surface, e.g., may have a solid light gray color. As a result, the trousers as being worn in the two different modes presents two different appearances.

In certain embodiments, decorative and/or functional accents and/or embellishments may be added to the garment and may be visible in one or both wearing modes of the garment. For example, as shown in FIG. 2, faux welt pockets may be added to the trousers. Other types of accents and embellishments may include belt loops, zippers, hems, buttons, ruffles, embroidery, and so on. The present disclosure does not limit the types and numbers of the accents and embellishments.

Figure 3:
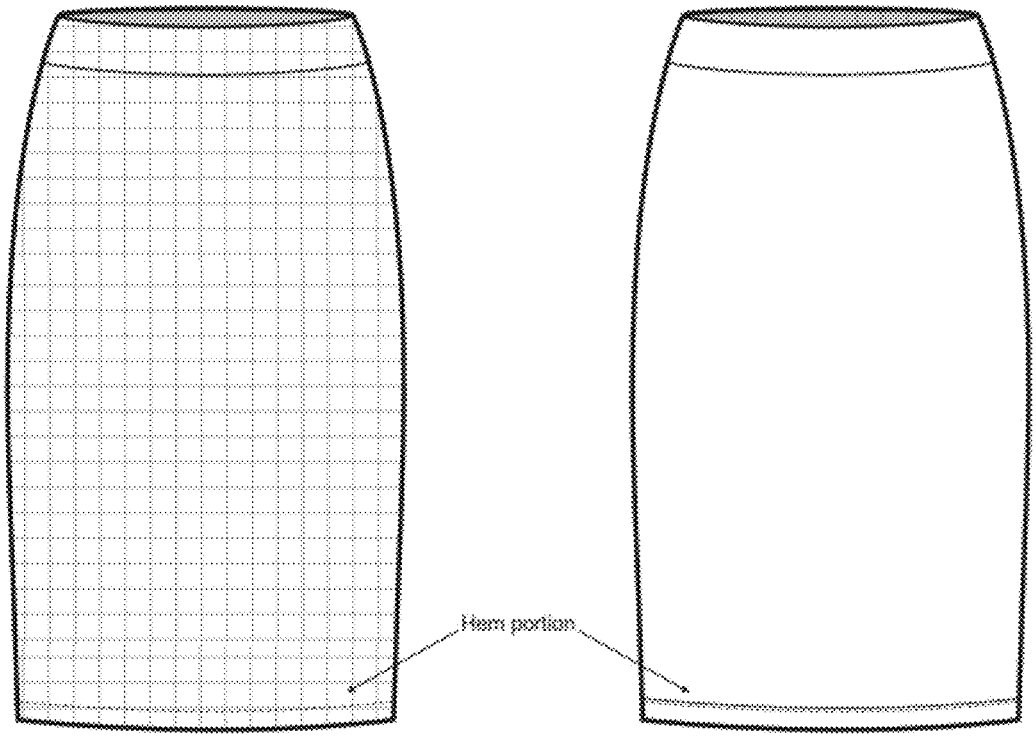
FIG. 3 illustrates another reversible garment according to certain embodiments of the present disclosure.

FIG. 3 shows another exemplary embodiment of the reversible garment. As shown in FIG. 3, in certain embodiments, the reversible garment may be a skirt made from a single layer of fabric. The left panel of FIG. 3 shows the skirt being worn in the first mode showing the first presenting surface of the fabric, and the right panel of FIG. 3 shows the same skirt being worn in the second mode showing the second presenting surface of the fabric. As shown in the left panel of FIG. 3, the first presenting surface of the fabric may have a first color and a first printed pattern, such as a dark gray checkered print. As shown in the right panel of FIG. 3, the second presenting surface of the fabric may have a different appearance from the first presenting surface, e.g., may have a solid black color. As a result, the skirt as being worn in the two different modes presents two different appearances.

Figure 4:
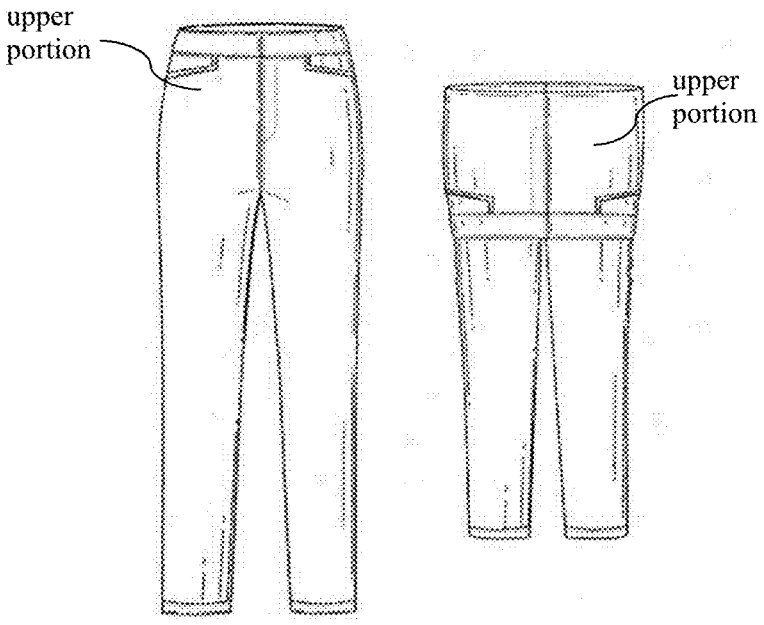
FIG. 4 illustrates another reversible garment according to certain embodiments of the present disclosure.

FIG. 4 shows another exemplary embodiment of the reversible garment. As shown in FIG. 4, in certain embodiments, the second wearing mode of the reversible garment may be that only a portion of the garment is presented to show the second presenting surface of the fabric. The left panel of FIG. 4 shows a pair of trousers being worn in the first mode and the right panel of FIG. 4 shows the same pair of trousers being worn in the second mode. As shown in the right panel of FIG. 4, when the trousers are being in the second mode, an upper portion of the trousers may be folded outwardly to present the second presenting surface of the fabric in the upper portion. As a result, the trousers as being worn in the two different modes presents two different appearances. In the first mode, the trousers may appear to be a pair of high-waist or normal-rise trousers. In the second mode, the trousers may appear to be a pair of low-rise trousers. In the exemplary embodiment shown in FIG. 4, the fabric may have two different appearances or a same appearance on the two surfaces.

Figure 5:
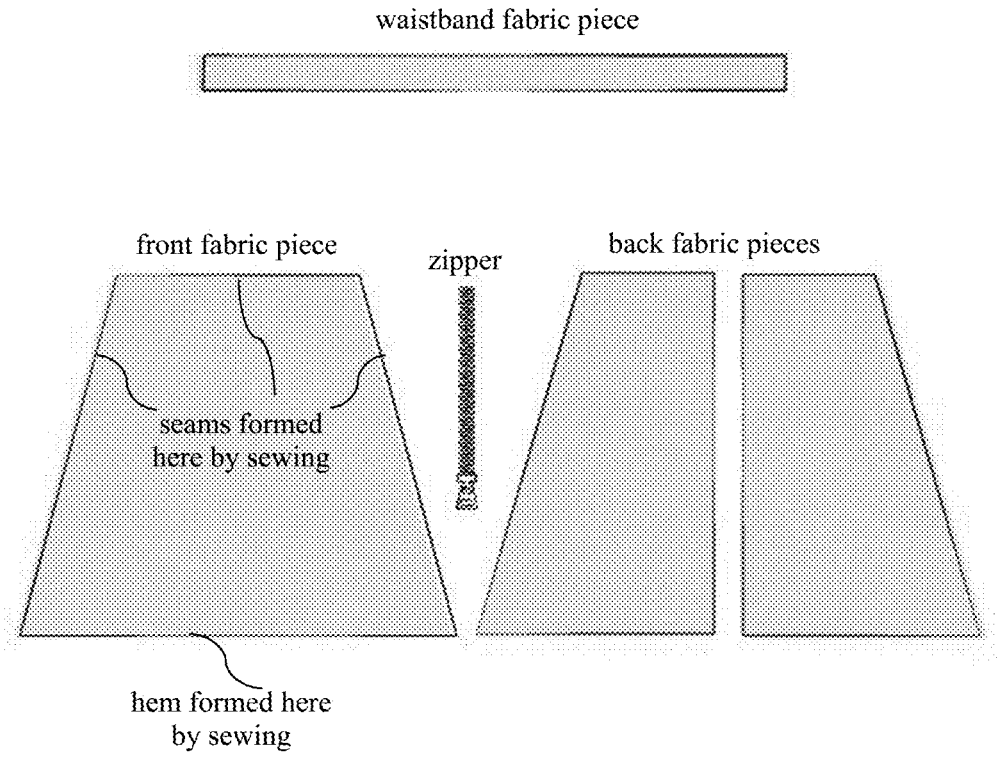
FIG. 5 illustrates components of a reversible garment according to certain embodiments of the present disclosure.

In certain embodiments of the present disclosure, the reversible garment may be constructed with a plurality of separated pieces of the fabric. The plurality of the fabric pieces may be sewn together to form the garment. As an illustrative and non-limiting example, a skirt may be formed by a front fabric piece, two back fabric pieces, and a waistband fabric piece, as shown in FIG. 5. These fabric pieces may be joined by seams at the edges of the fabric pieces by sewing to form the skirt. Dresses, blouses, shirts, trousers, and other type of garment may be similarly formed by joining multiple pieces of fabrics at the edges of the fabric pieces.

When two edges of two fabric pieces are joined by sewing, or when two different edges of a single fabric piece are joined by sewing, a seam is usually formed. Since most garments are designed and constructed to expose a single side of the fabric when being worn, seams of a single-layer garment are usually sewn in a manner that a portion of the construction, such as unfinished seam allowance is hidden in an internal surface of the garment. By contrast, according to certain embodiments of the present disclosure, one or more seams of the garment are constructed to provide a clean, finished look to both sides of the fabric. In certain embodiments of the present disclosure, all seams of the garment are constructed to provide a clean, finished look to both sides of the fabric. This way, when the garment is worn or presented in either the first mode or the second mode, the garment presents a clean, neat, finished appearance at the seams.

Figure 6:
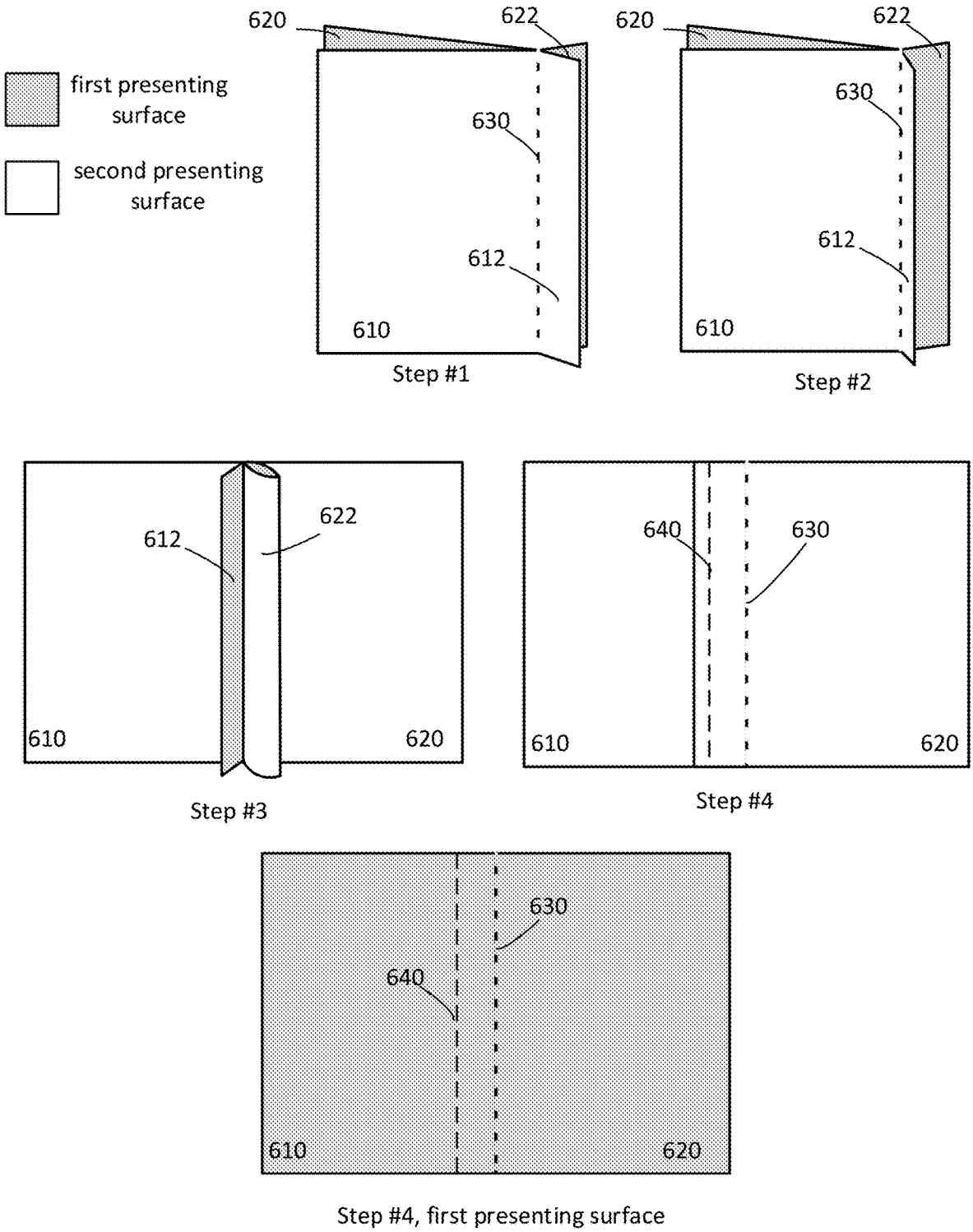
FIG. 6 illustrates a process to construct a seam of a reversible garment according to certain embodiments of the present disclosure.

In certain embodiments, the seams of the garment are constructed so that the seam allowance and fabric edges are enclosed in a seam so that the seam allowance and fabric edges are not visible on either side of the fabric when the seam is finished. FIG. 6 shows an exemplary embodiment of a seam construction process of the reversible garment. As shown in FIG. 6, at a first step, a first fabric piece 610 and a second fabric piece 620 are stitched together with a first stitch line 630 and with the first presenting surface of the first fabric piece 610 facing the second presenting surface of the second fabric piece 620. In a second step, a first seam allowance 612 of the first fabric piece 610 is trimmed to be narrower than a second seam allowance 622 of the second fabric piece 620 at the seam. In the third step, the second seam allowance 622 of the second fabric piece 620 is folded toward the first presenting surface of the fabric along the seam. And in the fourth step, the folded second seam allowance 622 of the second fabric piece 620 is stitched to the first fabric piece 620 with a second stitch line 640 that is parallel to the first stitch line 630. As a result of the illustrated process, fabric edges of both the first and the second fabric pieces are not visible on either side of fabric. Further, on either side of the fabric, the seam region presents a same fabric appearance (such as color and printed pattern) as the other portion of the presented surface of the garment, even though the first side and the second side of the fabric may have different appearances. Thus, the garment has a neat and clean appearance at the seams when it is worn or configured in both the first mode and the second mode.

In certain embodiments, colors of threads constructing the seams may be selected to coordinate with colors of the first presenting surface and the second presenting surface of the fabric. In certain embodiments, a single stitch line may be sewn using a top thread and a bottom thread. The top thread and the bottom thread constructing the stitch line may have different colors. For example, for the first stitch line constructing the seam, the top thread may have a first color and the bottom thread may have a second color different from the first color. The first color of the top thread may be selected to match the color of the first presenting surface of the fabric, and the second color of the bottom thread may be selected to match the color of the second presenting surface of the fabric. Similarly, different colors may be selected for the top thread and the bottom thread constructing the second stitch line to match the colors on the two opposite surfaces of the fabric. This way, thread colors may be coordinated with the presenting fabric colors on both sides of the fabric, giving the garment a neat and coordinated look.

In certain embodiments, certain fabric edges of the garment may be hemmed so the fabric edges are not visible at the presenting surface of the garment. In certain embodiments, the fabric edges are hemmed so that the fabric edges are not visible on either presenting surface of the garment worn or configured in the first mode or in the second mode. Further, in certain embodiments, the fabric edges are hemmed in a manner such that on either side of the fabric, the hem region presents a same fabric appearance (such as color and printed pattern) as the other portion of the presented surface of the garment in both modes, even though the first side and the second side of the fabric may have different appearances. These features may be seen in the examples shown in FIGS. 1-3. For example, as shown in FIG. 3, when the skirt is worn in the first mode (left panel), the hem portion at the bottom of the skirt presents a same dark gray checkered print matching the rest of the garment. When the skirt is worn in the first mode (right panel), the hem portion at the bottom of the skirt presents a same solid black color matching the rest of the garment.

Figure 7:
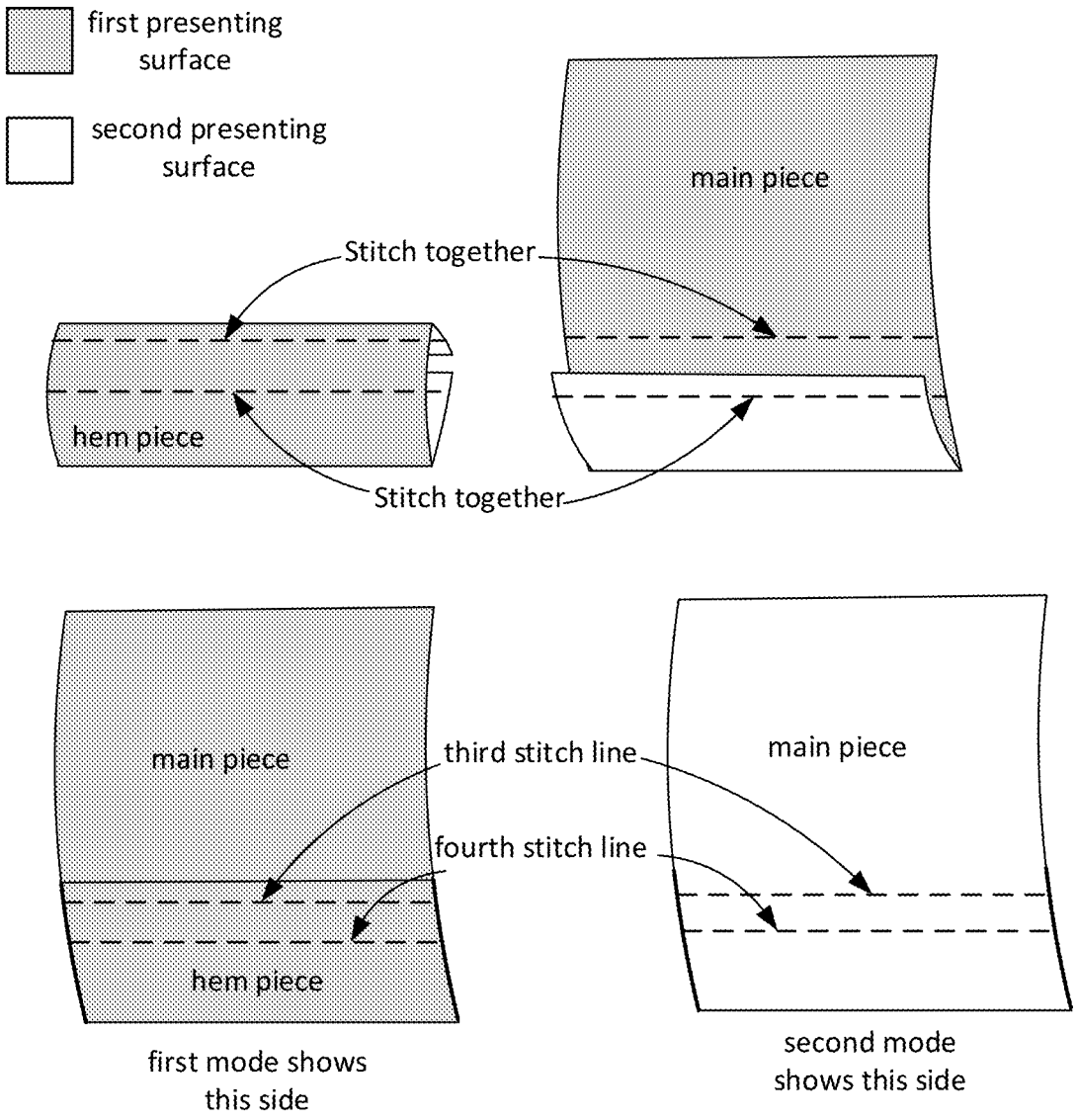
FIG. 7 illustrates a process to construct a hem portion of a reversible garment according to certain embodiments of the present disclosure.

FIG. 7 illustrates an exemplary embodiment of a hem construction process of the reversible garment. As shown in FIG. 7, a hem piece (as shown in the upper left panel of FIG. 7) made of the same fabric as a main piece (as shown in the upper right panel of FIG. 7) may be used to create a hem portion at the first presenting surface of the garment. The hem piece may be folded at a top edge and a bottom edge toward the second presenting surface, so the top and bottom edges may be hidden from view at the first presenting surface when the hem is constructed. The main piece may be folded at a bottom edge toward the first presenting surface, so the bottom edge of the main piece may be hidden from view at the second presenting surface. Subsequently, with two parallel stitch lines (shown as the third stitch line and the fourth stitch line in FIG. 7), the hem piece may be sewn to the main piece at the hem portion with the second presenting surface of the hem piece facing the first presenting surface of the main piece. As a result of the illustrated process, fabric edges of both the hem and the main fabric pieces are not visible on either side of fabric. Further, on either side of the fabric, the hem region presents a same fabric appearance (such as color and printed pattern) as the other portion of the presented surface of the garment, even though the first side and the second side of the fabric may have different appearances. Thus, the garment has a neat and clean appearance at the hem when it is worn or configured in both the first mode and the second mode.

In certain embodiments, colors of threads constructing the hem may be selected to coordinate with colors of the first presenting surface and the second presenting surface of the fabric. In certain embodiments, a single stitch line may be sewn using a top thread and a bottom thread. The top thread and the bottom thread constructing the stitch line may have different colors. For example, for the third stitch line constructing the hem, the top thread may have a first color and the bottom thread may have a second color different from the first color. The first color of the top thread may be selected to match the color of the first presenting surface of the fabric, and the second color of the bottom thread may be selected to match the color of the second presenting surface of the fabric. Similarly, different colors may be selected for the top thread and the bottom thread constructing the third stitch line to match the colors on the two opposite surfaces of the fabric. This way, thread colors may be coordinated with the presenting fabric colors on both sides of the fabric, giving the garment a neat and coordinated look.

Referring back to FIG. 5, in certain embodiments, the reversible garment may include a zipper which can be zipped and unzipped when the garment is worn or configured in the first mode or the second mode. In certain embodiments, the zipper may be a single-pull two-way zipper that functions when either of the first or second presenting surfaces of the garment fabric is presented outwardly.

In summary, the present disclosure provides a reversible garment and a construction method thereof. The reversible garment may provide different looks when worn in a first mode and a second mode. The second mode may be a mode in which at least a portion of the garment is configured in a reversed manner compared to the first mode. The main portion of the reversible garment may be constructed with a single layer of fabric comprising a first presenting surface and a second presenting surface. The first presenting surface of the fabric may have a different appearance from the second presenting surface. When the garment is being worn or configured in the first mode, the first presenting surface of the fabric is presented outwardly, and the garment may appear to be made of a fabric having the first appearance. When the garment is being worn or configured in the second mode, the second presenting surface of the fabric is presented outwardly at least for a portion of the garment, and the garment may appear to be made of a fabric having a second appearance. Accordingly, the garment as being worn in the two different modes presents two different appearances, providing the wearer versatility in dressing style without incurring additional expense, resource requirement, and storage space.

The objects and processes provided by the present disclosure according to the embodiments are described in detail above. The principles and implementation manners provided by the present disclosure are described herein by using specific examples. The description of the above embodiments is only used to help understand the method provided by the present disclosure. At the same time, a person skilled in the art will make changes the specific embodiments and the application scope according to the idea provided by the present disclosure. The contents of the present specification should not be construed as limiting the present disclosure.

The present disclosure contains material that is subject to copyright protection. The copyright is the property of the copyright holder. The copyright holder has no objection to the reproduction of patent documents or patent disclosure in the official records and files of the Patent and Trademark Office.

What is claimed is:

1. A reversible garment, comprising:

a plurality of pieces of a single layer of fabric joined by one or more seams, each seam constructed by joining a first edge of a first piece of the fabric and a second edge of a second piece of the fabric;

wherein:

the fabric includes a first presenting surface having a first appearance and a second presenting surface having a second appearance, the second presenting surface being opposite the first presenting surface, and the second appearance being different from the first appearance;

a main portion of the reversible garment is formed by the single layer of the fabric without a lining, and the reversible garment is configured to be worn in a first mode displaying the first presenting surface of the fabric outwardly and a second mode displaying the second presenting surface of the fabric outwardly;

for each seam, the first edge and the second edge are enclosed in the seam both when the reversible garment is worn in the first mode and when the reversible garment is worn in the second mode;

the reversible garment further includes one or more hems;

for each hem, the hem is constructed at an edge of one of the plurality of pieces of the fabric, and the hem is constructed so that the edge is hidden from view both when the reversible garment is worn in the first mode and when the reversible garment is worn in the second mode, and a hem portion presents a fabric appearance consistent with other portion of the reversible garment both when the reversible garment is worn in the first mode and when the reversible garment is worn in the second mode, the hem is constructed with a main piece of the fabric and a hem piece of the fabric, the hem piece forming the hem portion, and the hem is constructed by a process including:

folding a top edge of the hem piece toward the second presenting surface of the hem piece;

folding a bottom edge of the hem piece toward the second presenting surface of the hem piece;

folding a bottom edge of the main piece toward the first presenting surface of the main piece; and sewing the hem piece to the main piece at the hem portion with a third stitch line and a fourth stitch line parallel to the third stitch line, with the second presenting surface of the hem piece facing the first presenting surface of the main piece; and for each of third stitch line and the fourth stitch line constructing the hem, the stitch line is constructed using a top thread having a first color and a bottom thread having a second color, the first color being coordinated with the first appearance of the first presenting surface of the fabric, the second color being coordinated with the second appearance of the second presenting surface of the fabric, and the second color being different from the first color.

2. The reversible garment according to claim 1, wherein each seam is constructed by a process including:

stitching together the first piece and the second piece at the first edge and the second edge with a first stitch line, wherein the first presenting surface of the first piece of the fabric is arranged to face the second presenting surface of the second piece of the fabric;

trimming a first seam allowance at the first edge to cause the first seam allowance to be narrower than a second seam allowance at the second edge;

folding the second seam allowance toward the first presenting surface of the second piece of the fabric along the seam; and stitching the folded second seam allowance to the second presenting surface of the first piece of the fabric with a second stitch line, the second stitch line being parallel to the first stitch line.

3. The reversible garment according to claim 1, wherein:

the first presenting surface and the second presenting surface of the fabric have different colors, different printed pattern, and/or different fabric textures.

4. The reversible garment according to claim 1, further comprising one or more faux welt pockets.

5. The reversible garment according to claim 1, further comprising a single-pull two-way zipper configured to be zipped and unzipped both when the reversible garment is worn in the first mode and when the reversible garment is worn in the second mode.

6. The reversible garment according to claim 1, further comprising one or more of buttons, bell loops, ruffles, and/or embroideries.

7. The reversible garment according to claim 1, wherein the fabric is an elastic fabric.

8. The reversible garment according to claim 1, wherein the fabric is a non-elastic fabric.

9. The reversible garment according to claim 1, wherein the reversible garment is a dress.

10. The reversible garment according to claim 1, wherein the reversible garment is a blouse or a shirt.

11. The reversible garment according to claim 1, wherein the reversible garment is a skirt.

12. The reversible garment according to claim 1, wherein the reversible garment is a pair of trousers.

13. The reversible garment according to claim 1, wherein the fabric is made of wool, cotton, silk, linen, a synthetic material, a semi-synthetic material, or a blend of plurality of materials.

14. A reversible garment, comprising:

a plurality of pieces of a single layer of fabric joined by one or more seams, each seam constructed by joining a first edge of a first piece of the single layer of fabric and a second edge of a second piece of the single layer of fabric;

wherein:

the fabric includes a first presenting surface having a first appearance and a second presenting surface having a second appearance, the second presenting surface being opposite the first presenting surface, and the second appearance being different from the first appearance;

a main portion of the reversible garment is formed by the single layer of the fabric without a lining, and the reversible garment is configured to be worn in a first mode displaying the first presenting surface of the fabric outwardly and a second mode displaying the second presenting surface of the fabric outwardly;

for each seam, the first edge and the second edge are enclosed in the seam and hidden from view both when the reversible garment is worn in the first mode and when the reversible garment is worn in the second mode, and the seam is constructed by a process including:

stitching together the first piece of the fabric and the second piece of the fabric at the first edge and the second edge with a first stitch line, wherein the first presenting surface of the first piece is arranged to face the second presenting surface of the second piece;

trimming a first seam allowance at the first edge of the first piece to cause the first seam allowance to be narrower than a second seam allowance at the second edge of the second piece;

folding the second seam allowance toward the first presenting surface of the second piece along the seam; and stitching the folded second seam allowance to the second presenting surface of the first piece with a second stitch line, the second stitch line being parallel to the first stitch line; and for each of the first stitch line and the second stitch line constructing the seam:

the stitch line is constructed using a top thread having a first color and a bottom thread having a second color, the first color being coordinated with the first appearance of the first presenting surface of the fabric, the second color being coordinated with the second appearance of the second presenting surface of the fabric, and the second color being different from the first color.

* * * * *